United States Patent [19]

Lee

[11] 4,418,606

[45] Dec. 6, 1983

[54] POWDER MEASURING DEVICE FOR CARTRIDGE RELOADER

[76] Inventor: Richard J. Lee, 3146 Kettle Moraine Rd., Hartford, Wis. 53027

[21] Appl. No.: 485,148

[22] Filed: Apr. 15, 1983

[51] Int. Cl.[3] ..... F42B 33/02

[52] U.S. Cl. ..... 86/31; 86/23; 86/44

[58] Field of Search ..... 86/23, 28, 29, 31, 33, 86/44

[56] References Cited

U.S. PATENT DOCUMENTS

| | | | |
|---|---|---|---|
| 2,655,831 | 10/1953 | Veum | 86/31 |
| 4,157,053 | 6/1979 | von Trnkoczy | 86/28 |
| 4,186,646 | 2/1980 | Martin | 86/28 |
| 4,292,877 | 10/1981 | Lee | 86/31 |

*Primary Examiner*—Leland A. Sebastian

*Assistant Examiner*—Joel P. Okamoto

*Attorney, Agent, or Firm*—Wheeler, House, Fuller & Hohenfeldt

[57] ABSTRACT

A powder measuring device for use in connection with reloading cartridges has a powder transfer member supported for translating or, alternatively, rotating between a position where at least one cavity in the member is filled with powder from a hopper to another position wherein the powder is discharged through a tube to an empty cartridge. A cartridge to be reloaded is driven upwardly by a manually operated ram. The force for actuating the mechanism that drives the transport member is transmitted through the cartridge which means that unless a cartridge is positioned on the ram for receiving the powder the transport member will not be moved in response to operation of the ram and unintended discharge of powder will be prevented.

11 Claims, 10 Drawing Figures

POWDER MEASURING DEVICE FOR CARTRIDGE RELOADER

BACKGROUND OF THE INVENTION

This invention relates to apparatus for reloading cartridges used in pistols and rifles and relates more specifically to a device for loading a cartridge with a predetermined quantity of powder.

During the reloading process, it is necessary to provide an accurately measured quantity of powder to the cartridge. Usually, the measuring device has a cavity that is filled from a powder hopper and then transferred to an opening that registers the cavity over a drop tube that communicates with the open end of the cartridge. In some prior art designs, the cavity is either adjustable in size, or changed in size with bushings and in other designs a movable member, usually called a charge bar, that contains the cavity, is substituted for a member having a cavity of different size to dispense a different volume of gunpowder.

In some prior art reloaders, the powder measuring device is combined with an expander element so the neck of the cartridge can be expanded to a proper dimension for receiving a bullet at the same time that the cartridge is being charged with powder. In this case, the powder drops through a hole in the expander plug. There are also prior art devices that have the charge bar or movable member operated automatically through cams and links so that every time an operating lever is actuated manually, powder is discharged whether or not there is a cartridge in place to receive it. This is obviously highly disadvantageous. Moreover, none of the prior art devices permit easy inspection of the drop tube to assure that the entire charge has dropped into the cartridge. If some of the powder accumulates in the drop tube, variable quantities of powder may be fed into the cartridges which could result in undercharging in some cases and dangerous overcharging in others.

SUMMARY OF THE INVENTION

In the present invention, the cartridge itself is used to actuate the charge bar or powder transport member. This assures that no charge will be dropped if no cartridge is present during a stroke of the reloading apparatus manual operating lever. In one embodiment, the cartridge neck expanding operation is combined with the powder charging operation by having a hole through an expander plug to permit the powder to pass through to the cartridge. In cases where expanding is done separately from the powder filling operation, the device can be made to work with an element that is substituted for the expander.

In general terms, the new powder measuring device is typically used with a cartridge reloading apparatus or tool having ram means for driving the cartridge in alternate axial directions and having a support for the measuring device. An adapter having an axial bore is mounted on the support. A tubular element in the adapter bore is subject to being driven in one axial direction in the bore by a force derived from a cartridge being driven into the bore in alignment with the tubular element so a measured quantity of powder can drop through the tubular element into the cartridge. A powder transport member having at least one powder carrying cavity is driven in response to movement of the tubular element. If the ram or other driving means in the reloader does not have an empty cartridge in place, the driving force of the ram cannot be transmitted to the tubular element in which case the powder transport member will not move from a powder cavity loading position to a discharge position.

In one embodiment, the measuring bar or powder transport member is circular and is mounted for moving linearly between powder cavity loading and discharge positions along guide grooves and there are projections on the member which fit into the guide grooves and prevent its rotation. Powder cavities of different sizes are arranged in a circular pattern on the powder transport member. The member can be easily removed from its supporting body and rotated and returned for another pair of projections to fit into the grooves that will dispose a selected cavity on the path between the powder loading and powder discharge positions.

In another embodiment, a cylindrical transport member having the cavities is rotatable on a horizontal axis. It is driven rotationally in response to driving a cartridge against the movable tubular element of effect rotation of the cylinder from one position where its cavity accepts a full charge of powder and then to another discharge position.

A feature of the preferred embodiment is that it provides for visually inspecting the bore through the powder drop tube without disassembly so the user can be sure that each charge has completely cleared the tube.

Another advantage, particularly, of the first embodiment mentioned above is that it affords an opportunity to see if the correct measuring cavity is in place since each movement of the charge transport member to its second position exposes the cavity and lettering which then becomes exposed indicates the capacity of the cavity.

Another feature of the invention is the unique manner in which a single tension spring holds the parts of the new measuring device together so they do not need to be otherwise mechanically fastened.

How the foregoing objects and features of the invention are achieved will be evident in the more detailed description of embodiments of the invention which will now be discussed in reference to the drawings.

DESCRIPTION OF A PREFERRED EMBODIMENT

Figures 1, 4, 4A, 5, 6:
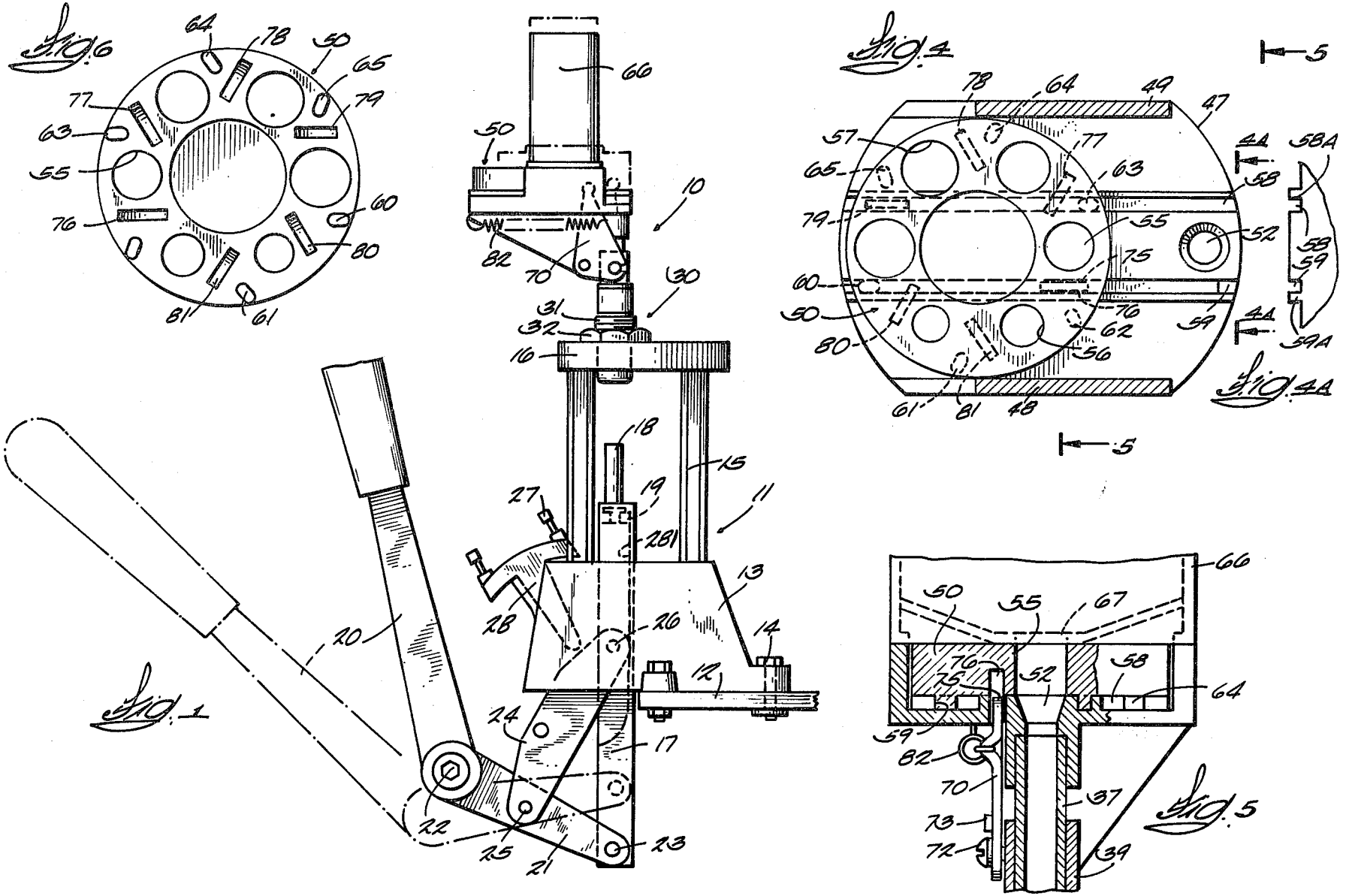
FIG. 1 is a side elevation view of a cartridge reloading press, having parts broken away, together with a side elevation view of the new powder measuring device.
FIG. 4 is a section taken on a line corresponding with 4—4 in FIG. 2 and provides a plan view of a circular multi-cavity powder charge transport member situated for moving linearly along guide grooves.
FIG. 4A is a fragmentary view showing the profile of the guide grooves.
FIG. 5 is an irregular vertical section taken on the lines corresponding with 5—5 in FIG. 4.
FIG. 6 is a bottom view of the circular powder transport member which also appears in FIG. 4.

In FIG. 1, the new powder measuring device is designated generally by the reference numeral 10. It is mounted on a fragmentarily shown manually operated reloading press which is designated generally by the numeral 11. This press is shown and described in detail in patent application Ser. No. 280,677, filed July 6, 1981, now U.S. Pat. No. 4,393,744. FIG. 1 shows sufficient detail of one of the types of reloading presses with which the powder measuring device 10 can be used. The press comprises a platform 12 on which a housing 13 is mounted by means of bolts 14. A plurality of posts 15 are mounted to housing 13. A support member 16 is mounted on the posts. The press is provided with a cylindrical ram 17 that is supported for moving axially up and down in housing 13. The ram constitutes a means for driving a shell casing or cartridge 18 in opposite axial directions. The head of cartridge 18 is registered in a suitable slot 19 in the upper end of ram 17. The details of a suitable cartridge holding slot can be seen in the cited application.

A manual operating lever for reciprocating the ram 17 axially is marked 20. Operating lever 20 is coupled to another operating lever section 11 by means of a clamping bolt 22 so that, effectively, parts 20 and 21 comprise a single lever. The lever is pivotally connected at 23 to ram 17. Another link 24 is pivotally connected at 25 to lever section 21 and at its other end link 24 is on a pivot pin 26 which is fixed on housing 13. Swinging lever 20 counterclockwise to the position in which it is depicted in phantom lines in FIG. 1 causes the ram 17 to be driven upward and thus, put the cartridge 18 in a position for applying a driving force to the powder measuring device 10 operating mechanism as will be described in greater detail.

In the particular press depicted in FIG. 1 and shown in the cited application, a primer is inserted in the head of cartridge 18 by means of a spring biased primer holder such as the one marked 27. The primer holder is on an arm 28 which pivots in a socket so as, for example, to dispose primer holder 27 in the path of the head of cartridge 18 to insert the primer by retracting the ram 17 downwardly. The ram has a longitudinally extending slot 281 whose open side faces the primer holding lever 28 so it can swing into the path of the cartridge 18 for inserting the primer.

For the sake of simplicity only the powder measuring device 10 is shown mounted to support member 16 on the press. As is known to those who are familiar with cartridge reloading tools, the support member 16 is usually rotatable about a vertical axis and is provided with a plurality of dies for performing such operations as shaping the open ends or necks of the cartridges so they will accept a bullet and for inserting bullets in the cartridges. Devices for performing operations other than measuring and inserting a definite quantity of powder into cartridges are not shown since the new powder measuring device can be shown and described independently of other operations.

Figure 2:
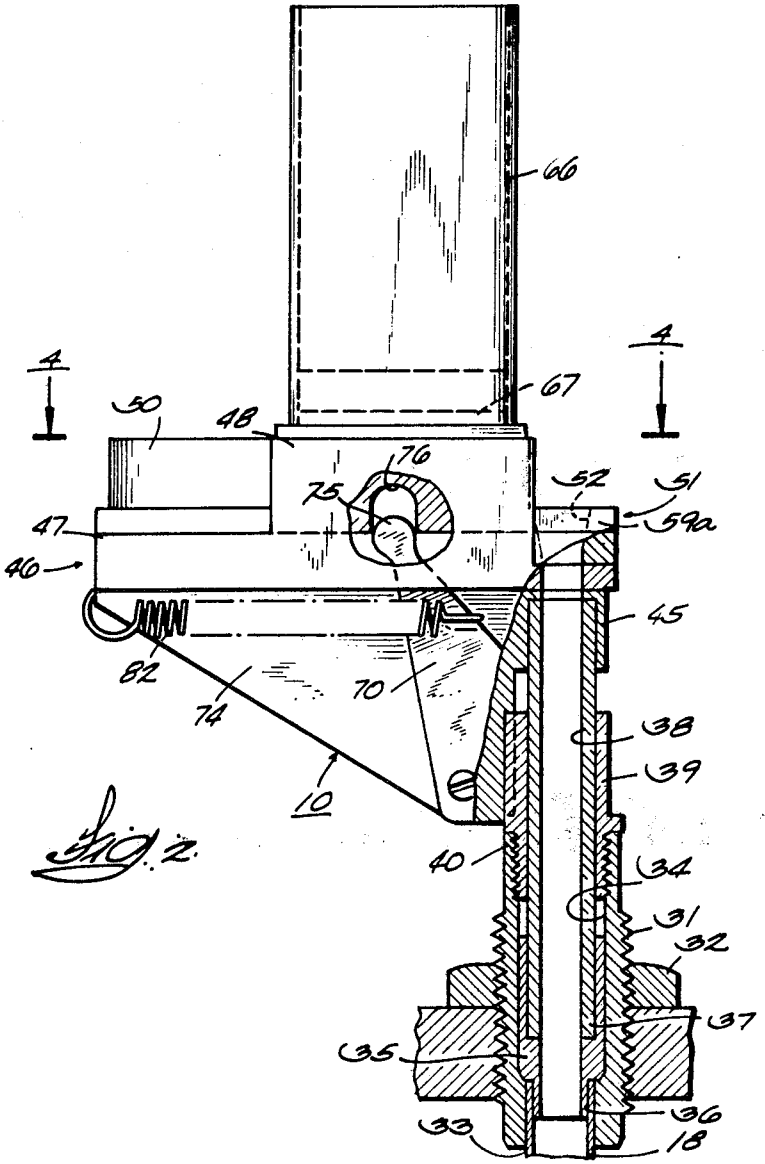
FIG. 2 is a side elevation of the powder measuring device, partly in section, and showing its parts in one of the operating stages.

Still referring to FIG. 1, the powder measuring device 10 includes an adapter 30 having an external thread 31 that turns into support member 16 and is locked therein by means of an internally threaded lock nut 32. Adapter 30 is shown in section in FIG. 2 to which attention is now invited. The bullet receiving mouth or open end of the cartridge 18 has just entered the open lower end 33 of adapter 30. The adapter has a coaxial internal bore 34. In the illustrated embodiment, an expander or cartridge mouth sizer 35 is disposed in bore 34 and it has axially beveled circular tip 36 which enters the mouth of the cartridge 18 and shapes the cartridge when it is driven onto the tip 36 under the influence of ram 17. Expander or cartridge sizer 35 makes a close sliding fit in adapter bore 34. The sizer has slip-fitted into it a tubular element 37 having an internal bore 38 constituting a passageway or drop tube for letting powder drop into cartridge 18 when the measuring device is in one of its actuated stages. In designs where sizing of the cartridge mouth is done in a preceding operation, the sizer 35 can be dispensed with and the force for driving tubular member 37 axially can be applied directly to tubular member 37 or it can be provided with an inverted funnel-shaped element, not shown, to assure alignment of the cartridge and tubular powder drop element while the ram driven cartridge is moving the element axially. In FIG. 2, one may see that a collar 39 is threaded at 40 into the upper end of adapter 30 to provide further guidance to axially movable tubular element 37.

Figure 3:
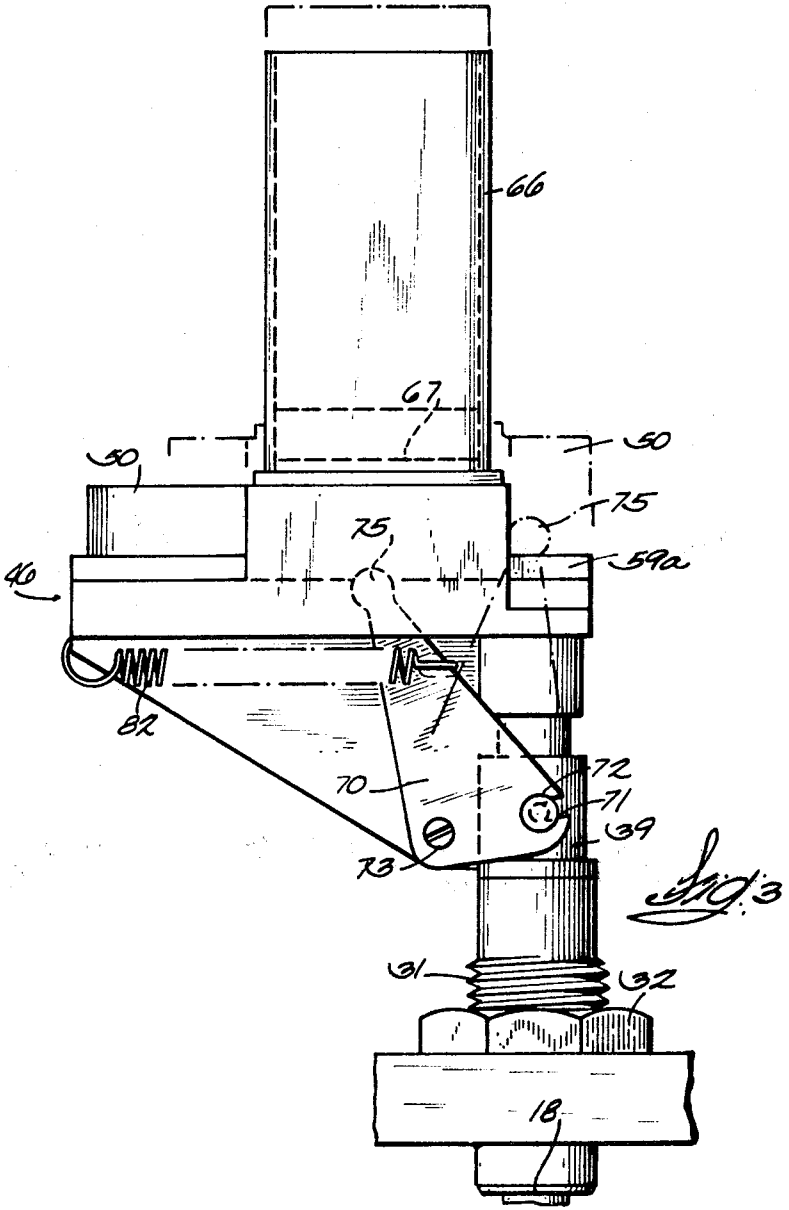
FIG. 3 shows the device in another of its operating stages.

The upper end of tubular element 37 fits into a socket hole 45 that is in the outboard end of a cast body 46 which has a base portion 47 and upstanding sides one of which, 48, is visible in FIGS. 2, 3 and 4 and the other of which, 49 is visible in FIG. 4. As will be seen later, the force of a spring 82 acting on an operating lever 70 is utilized in a way that keeps the parts assembled. It will be evident in FIG. 2 that if tubular element 37 is forced upwardly by reason of the cartridge 18 being driven upwardly by the ram 17, the whole body 46 will be lifted upwardly to a limiting position which is indicated by the phantom lines in FIG. 3.

There is a circular and translatable multiple-cavity powder transport member 50 shown partially exposed in FIG. 2 and illustrated in a top view in FIG. 4. The active cavity, whose volume determines the size of the charge, is selectable. Referring to FIG. 2, the body 46 extends forwardly or outwardly at the place marked 51. The body is provided with a hold 52 that has a funnel-shaped mouth into which powder transport member 50 discharges a measured quantity of powder from an active cavity when the member 50 is shifted so that its presently unexposed side in FIG. 2 extends over projection 51 of the base 46.

Referring to FIG. 4, one may see that powder transport member 50 is basically a disk that is provided with several holes or cylindrical cavities arranges in a circular pattern. The cavity that is presently active to receive and discharge a specific measured quantity of powder is marked 55. The other cavities such as those marked 56 and 57 have equal axial lengths but different diameters so as to provide for being filled with different quantities of powder. As can be seen in FIGS. 4 and 4A, body 47 is provided with a pair of parallel grooves 58 and 59 and ridges 58A and 59A defining tracks that guide circular powder transport member 50 linearly. As shown in the plan view of the powder transport member 50 and in the bottom view in FIG. 6, the member in this embodiment is provided with six downwardly projecting protuberances which are marked 60–65. As shown in FIG. 4, protuberances 60 and 63 are presently registered in grooves 58 and 59 in the flat bed of body 47. Thus, circular powder transport member 50 is constrained to move in a linear path defined by grooves 58 and 59. When the circular powder transport member 50 is in its FIG. 4 position, cylindrical cavity 55 is in a position for being loaded with powder from a hopper 66 which is mounted to the body 47 and is located above circular powder transport member 50. The hopper has a port 67 in its bottom for discharging powder into a selected one of the cavities, such as cavity 55, which is presently aligned with the hopper port in FIG. 4. When a cylindrical cavity such as the one marked 55 in FIG. 4 is filled, transport member 50 is shifted forward or to the right in FIG. 4 to dispose the cavity 55 over funnel-shaped inlet 52 in body 47 to permit the powder to fall into axially movable tubular element 37 for passage to cartridge 18. FIG. 5 shows the transport member 50 after it has been shifted to align the port 55 with the funnel-shaped mouth 52 that leads to drop tube 37.

An important feature of the invention is that multi-cavity circular transport member 50 can be slid off of the body 47 along guide grooves 58 and rotated to align a different one of the cylindrical powder measuring cavities such as the one marked 57 on the path between loading position and discharge position. Assuming in reference to FIG. 4 that cavity 57 is made to occupy the position in which cavity 55 is presently shown. In such case, guide protuberances 65 and 62 would be disposed in guide grooves 58 and 59, respectively. In other words, protuberance 65 would take the place of presently positioned protuberance 63 and protuberance 62 would take the place of presently positioned protuberance 60. The volume of cylindrical cavity 57 is greater than that of cavity 53 so larger quantities of powder would be delivered to the drop tube 37 and the cartridge 18.

Consideration will now be given to the manner in which circular powder transport member 50 is shifted between a powder charge loading position and discharge position.

In the preferred embodiment, the powder transport member 50 is shifted by an actuating means comprising a lever comparable to a bell crank and marked 70. Lever 70 can be seen in FIGS. 1–3 and 5. As shown in FIGS. 3 and 5, lever 70 is provided with an open-ended slot 71 for passing over a pin 72 which is fixed in collar 39. Collar 39 remains stationary when ram 17 drives a cartridge 18 into the device as can be seen in FIG. 2. Lever 70 has another pin 73 extending through it and the end of this pin is screwed into a rearwardly extending web 74 which is part of the case body 47. Referring to FIG. 2, one may see that when a cartridge 18 is driven into the device with the ram 17, the force is transmitted to tubular element 37 which, since it is attached to the body 47 in the socket 45, causes the entire body to lift. Coordinately with this operation, lever 70 will swing from its solid line position in FIG. 3, for instance, to its phantom line position and, as a result, transport member 50 will be moved up and driven forward or to the right in FIG. 3 where it is shown in its phantom line position wherein it allows discharge of the powder from the presently active cavity 55. Lever 70 is engaged with transport member 50 at its circular end 75. The bottom of the transport member 50 is provided with a plurality of rounded notches 76–81. In FIGS. 2 and 4, the circular end 75 of lever 70 is registered in notch 76. Thus, when the lever 70 pivots on pin 73, the transport element 50 is translated as a result of lever end 75 registering in notch 76. A coil spring 82 is hooked into a socket in the lever 70 and is hooked at its other end to base 47 as shown in FIGS. 2, 3 and 5. When the ram 17 is retracted or shifted downwardly so as to withdraw cartridge 18 from adapter 30, the spring retracts lever 70 from its phantom line position in FIG. 3 to its solid line position, thus restoring powder transport member 50 to a position wherein it will be reloaded with a powder charge from the hopper.

It is important to recognize that transport member 50 cannot move at all unless there is cartridge 18 on ram 17 since it is the cartridge that actually couples the ram to the axially slidable drop tube 30 on which the whole device is lifted to cause operation of lever 70 when the ram is driven upwardly. This assures that no powder can be dropped into tubular element 37 if someone operates manual lever 30 on the press when there is no cartridge 18 present on the ram to receive powder.

Although it is not visible in the drawings, the circular powder transport member 50 has numbers stamped in it adjacent each of its cylindrical cavities such as the one marked 55. These numbers indicate the volume of the cavity or the size of the powder charge. Any number indicative of the volume of the active cavity becomes exposed each time the powder transport member 50 is driven forwardly to expose the end of its upper surface in the region 51 in FIG. 2, for example. Observe also that when the transport member is driven to where the powder contents of a cavity can drop into the cartridge, one may look through the cavity and funnel-shaped mouth 52 in FIG. 2 and down the bore 38 a tubular element 37 to confirm whether or not every bit of the charge has dropped into the cartridge 18. Actually, in use, the powder measurer is turned 180° on adapter thread 33 so the user does not have to look over the hopper to see down mouth 52. This also assures that the handle 20 will not strike the measurer when the handle is in its uppermost position.

In the FIGS. 1–5 embodiments as implied earlier, the transport member 50 can be removed and rotated as desired to arrange any one of the cylindrical powder charge-containing cavities in alignment wth the drop tube 37. By way of example, referring to FIG. 2, removal can be accomplished by applying a force to the rear of transport member 50 to cause it to be exposed at its other end as if it were driven there by operation of lever 70. Then, a further application of the manual force results in the notch sliding off of the rounded end 75 of lever 70 in which case transport member 50 can be completely removed, rotated and restored while setting its aligned notch on the rounded and now exposed end 75 of lever 70. Once the end and new notch are re-registered, spring 82 will retract transport member 50 to its most rearward position again and a new cavity will be activated. A different pair of protuberances 60–65 will also be registered in guide grooves 58 and 59. Thus, it will be seen that the spring holds the parts together.

To recapitulate the preferred embodiment, a cartridge charging operation involves positioning a cartridge 18 on ram 17 and actuating operating lever 70 to drive the ram upwardly from its FIG. 1 position to thereby raise the cartridge to its FIG. 2 position wherein it begins engagement with cartridge mouth sizer tip 36. At this time, tubular element 37, that is, the powder drop tube is driven upwardly by some amount and the whole body 46 of the device begins to lift. At about the same time lever 70 starts powder transport member 50 moving. Completion of the upward stroke of the ram 17 drives lever 70 to its normal limit of rotation which moves transport member 50 to where a powder charge cavity becomes aligned with the drop tube for the powder to be discharged to cartridge 18. The ram and, hence, the cartridge 18 are then retracted and the cartridge is ready for insertion of a bullet, not shown, in the cartridge mouth.

Figure 9:
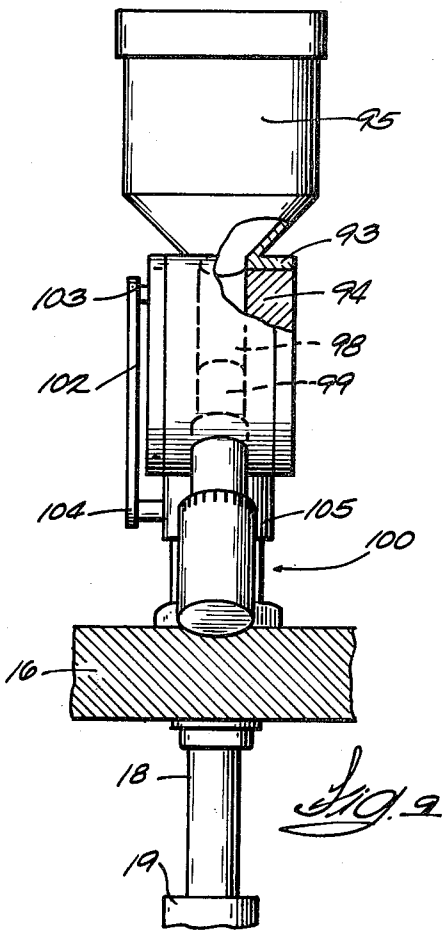
FIG. 9 is a front elevation view of the powder loading device of the two preceding figures when it is in an operating position comparable to the position it is in in FIG. 7.
Figure 8:
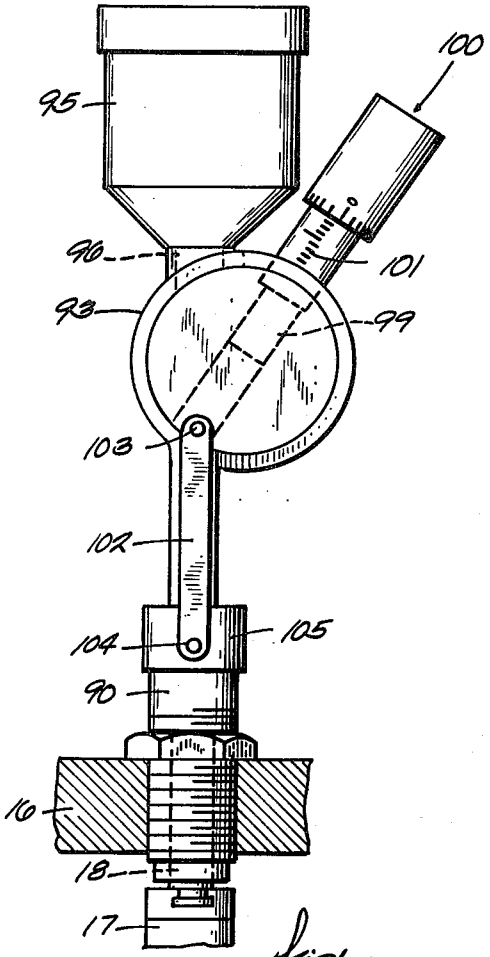
FIGS. 7 and 8 are side elevational views of an alternative embodiment of the invention wherein the powder transport member is rotatable rather than translatable as in the previous embodiment.
Figure 7:
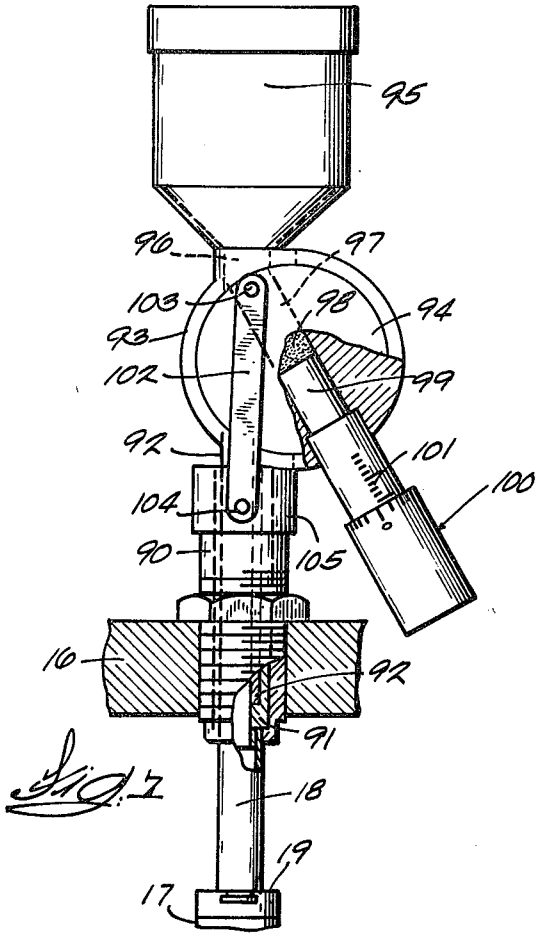

Another embodiment of the invention which exemplifies the feature of prohibiting powder discharge unless there is a cartridge in position to receive it is shown in FIGS. 7, 8 and 9. In the latter embodiment, the features are implemented in a somewhat different way than in the FIGS. 1–5 embodiment.

The FIGS. 7–9 model is shown in a somewhat schematic manner but in sufficient detail to demonstrate its features. In FIG. 7, the powder measuring device comprises an externally threaded adapter 90 which screws into a support 16 on a reloading press such as the one shown in FIG. 1. The press has a vertically reciprocating manually operated ram 17, a cartridge holder 19 and, presently, there is a cartridge 18 held in the holder. The adapter 90 has an internal bore in which there is a cartridge mouth sizer 91 that is slidable through a limited distance within the bore of the adapter. Also in the adapter bore and pressed fit into the sizer there is a tubular element 92 whose bore constitutes a passageway for dropping powder into cartridge 18. Tubular element 92 extends upwardly and through the adapter. At the upper end of tubular element 92 a non-rotatable cylinder 93 is fastened with its axis lying horizontally. A cylindrical powder transport member 94 is rotatable within cylinder 93. A powder hopper 95 having an output port 96 is formed integrally with and mounted on cylinder 93. Rotatable cylindrical transport member 94 has a diametral hole 97 through it. When the parts are in their FIG. 7 position, hole 97 is aligned with output port 96 of the hopper. The hole has a micrometer stem 99 in it to define the depth and volume of a powder measuring cavity 98. The amount of powder entering cavity 98 depends on the position of stem 99 which projects from an adjustable micrometer 100. The body of the micrometer has a scale 101 on it which is calibrated in terms of the volume of the cavity 98 that receives the charge of powder from the hopper. By adjusting the micrometer stem 99 position, the cavity volume can be altered to match it with the amount of powder that is appropriate for the casing 18 that is to be refilled with powder. In FIG. 7, cylinder or powder transport member 94 has been rotated to its cavity 98 loading position which is the normal position of the cylinder until it is rotated counterclockwise as in FIG. 8 by reason of a cartridge 18 having been driven in by ram 17 to move tubular element 92 axially. There is a crank link 102 pivotally connected to the cylinder with a drive pin 103 at one end and pivotally connected by means of a pin 104 that extends from a collar 105 which is fixed on adapter 90.

Refer now to FIG. 8 where the ram 17 and the cartridge 18 thereon has been driven into adapter 90. Drop tube 92 has thereby been moved axially upward to extend it out of adapter 90. Since the annular cylinder 93, internal cylinder 94 and hopper 95 are integral, these parts are lifted up with tubular powder dropping element 92. Moving the cylinder away from the adapter results in the crank line 102 rotating cylinder 94 counterclockwise to permit the powder contents of cavity 98 to be spilled into drop tube 92 whose internal passageway conducts the powder to the cartridge 18. Now, when the ram 17 is retracted vertically it carries cartridge 18 with it and, since cylinder 94 is unrestrained and counterbalanced by the weight and leverage of the micrometer 100, this weight and, of course, the weight of the hopper and cylinder causes tubular element 92 to drop down again to its resting position as shown in FIG. 7.

FIG. 9 shows a side view of the device in FIGS. 7 and 8. The operating stage of the device in FIG. 9 corresponds with that in FIG. 7. In FIG. 9, one may see how the actuating link 102 connects into the end of internal cylinder 92.

It will be evident that in the FIGS. 7–9 embodiment tubular element 92 will not be subject to upward shifting to permit discharge of powder unless the tubular element is driven by the cartridge 18 under the influence of ram 17. In the absence of a cartridge, the parts of the device will remain as they are depicted in FIG. 7.

Although two embodiments of a powder measuring device in which a powder transport member can only be actuated under the influence of a force transmitted through a cartridge have been described in considerable detail, such description is intended to be illustrative rather than limiting, for the concepts of the invention may be variously implemented so the true scope of the invention is to be limited only by interpretation of the claims which follow.

I claim:

1. A device for measuring the quantity of powder that is inserted in a cartridge in a reloading apparatus having means for driving the cartridge in alternate axial directions and having a support for the device, said device comprising:

an adapter for being mounted on said support and having an axial bore, a tubular element in the adapter bore, said element subject to being driven in one axial direction in said bore by a force transmitted through a cartridge being driven into said bore in alignment with said element, a body supported from said tubular element outside of said adapter, a powder transport member mounted for moving on said body, said member having at least one cavity corresponding in size to the quantity of powder desired in the cartridge, said cavity being located for being loaded with a quantity of powder when said member is in one position and for discharging said quantity through said tubular element into said cartridge when in another position, and drive means engaged with said transport member and responsive to said tubular element being driven in said one axial direction by said force transmitted through a cartridge by driving the transport member alternately between cavity loading position and cavity discharge position.

2. The device according to claim 1 wherein:

said transport member is movable along a linear path on said body and is provided with at least another of said cavities and said cavities are open at both ends for a selected one of said cavities to be loaded with powder through one end when said member is in said loading position and to discharge powder from the other end when in said discharging position, and means for guiding the movement of said transport member such that one of said cavities follows a linear path between loading and discharging positions when said member is in one orientation relative to said body and such that the other of said cavities follows the same linear path when said transport member is changed to another orientation relative to said body.

3. The device according to claim 2 wherein said body has a planar surface on which the transport member moves and said surface keeps said other end of the cavity closed until the cavity reaches discharging position in alignment with the tubular element and said guide means includes a groove in said planar surface for defining said linear path, the transport member guide means includes a plurality of protuberances for selectively registering in said groove, the protuberances being arranged relative to respective cavities such that when one protuberance is in the groove a selected one of said cavities will be moved in a linear path between loading and discharging positions and when the orientation of said member is changed another of said protuberances will register in said groove and the transport member and another of said cavities therein will then be constrained to move in said linear path between loading and discharging positions.

4. The device according to any of claims 2 or 3 wherein when a cavity in said transport member is in powder discharging position an observer looking into said one open end of the cavity will be able to see the interior of said tubular element to determine if all of the powder has passed into the cartridge.

5. The device according to claim 2 wherein:

said linearly movable transport member is a disk-like member having a top surface and a generally planar bottom surface the latter of which interfaces with and moves on a corresponding generally planar surface on said body, said bottom surface having a plurality of angularly spaced apart notches arranged in corresponding positions relative the respective cavities, said drive means comprising lever means having one end swingable on said adapter means and another end engaged in a predetermined one of notches when said member is in one orientation, said lever means having intermediate of its ends a pivotal connection to said body such that when said tubular element and body are driven under the influence of a cartridge said lever means will swing and move said transport member from loading to discharge position, spring means operative to return said transport member from discharge position to loading position, manually forcing said transport member beyond said discharging position causing said lever to disengage the member to permit removal and turning it to orientation for another of said notches to be engaged by said lever when said member is restored to thereby dispose a cavity on said linear path other than a cavity that was in the path in said one orientation of the member.

6. A device for measuring the quantity of powder that is inserted in a cartridge in a reloading apparatus having a ram movable within predetermined limits for driving a cartridge in alternate axial directions and having a support for the device, said device comprising:

adapter means for being mounted on said support and having an axial bore, a tubular element in the adapter bore, said element subject to being driven in one axial direction in said bore by a force transmitted through a cartridge when a cartridge is mounted on said ram, a body mounted on said tubular element and having a generally planar surface extending transversely to the axis of said tubular element, said body having a powder discharge hole through it aligned with said tubular element, a powder hopper mounted to said body and having an output port spaced from said generally planar surface, a powder transport member disposed between said port and said surface and movable on said surface, said member having a plurality of through-holes constituting cavities for transporting powder from powder loading position next to said port to discharge position aligned with said discharge hole, guide means for constraining said transport member to move linearly to thereby hold a selected one of said cavities on a linear path between said port and said powder discharge hole when said member is in one orientation on said surface and to dispose another of said cavities on the same linear path when said member is in another orientation on said surface, said transport member having a plurality of notches presented toward said surface, lever means having one end swingable on said adapter and another end engaged in a predetermined one of said notches when said member is in one orientation, said lever means having intermediate of its ends a pivotal connection to said body such that when said tubular element and body are driven under the influence of a cartridge said transport member will move and shift the cavity on the linear path from loading position to discharging position, and spring means engaged with said lever means for returning said transport member to loading position when the ram is retracted to take the cartridge out of driving relation with said tubular element.

7. The device according to claim 6 having parts constructed and arranged so that when said transport member is manually pushed to a position beyond the discharging position of said cavity obtainable by operation of said lever means, said other end of the lever means will disengage from said one notch to release said member for being turned to another orientation after which it can be restored to engage another of said notches.

8. The device according to any of claims 6 or 7 wherein when said transport member is shifted to cavity discharging position said through-hole defining the cavity is exposed to permit an observer to look through the hole and through said tubular element to determine if all of the powder has entered the cartridge.

9. The device according to any of claims 6 or 7 wherein said guide means for said transport member comprises a plurality of protuberances on said members each of which are positioned the same relative to the center of one of the holes, said generally planar surface having a groove defining the linear path for at least one of the protuberances to register in the groove so as to guide the member along said linear path when said member is in one orientation and for another protuberance to register in the groove to guide the member when in another orientation.

10. The device according to claim 1 wherein:

said body supported from said tubular element is a cylinder means having its axis disposed transversely to said tubular element axis, a hopper for powder mounted to said cylinder means, said cylinder means having one hole communicating with said hopper and another angularly displaced hole communicating with said tubular element, said transport member comprising a cylindrical member mounted for rotation in said cylinder means and having a cavity extending generally transversely to its axis such that when said member is rotated into powder loading position said cavity aligns with said hole in the cylinder communicating with said hopper and when rotated into powder discharge position said cavity aligns with the hole communicating with said tubular element, said drive means comprising crank means pivotally connected to said adapter means and to said cylindrical member such that when said tubular element is driven axially by a force transmitted through a cartridge said crank means will rotate said member from where said cavity is in loading position to where said cavity is in discharging position.

11. The device according to claim 10 including stem means extending into said cavity and providing a bottom therefor, and means for adjusting the position of the stem means in the cavity to thereby establish the volume of the cavity and the quantity of the powder it will transport.

* * * * *